United States Patent [19]

Haury et al.

[11] 4,387,281

[45] Jun. 7, 1983

[54] ARC BLOWING CHAMBER

[75] Inventors: André Haury, Le Raincy; Lucien Siffroi, Versailles, both of France

[73] Assignee: La Telemecanique Electrique, France

[21] Appl. No.: 304,478

[22] Filed: Sep. 22, 1981

Related U.S. Application Data

[63] Continuation of Ser. No. 27,587, Apr. 6, 1979, abandoned.

[51] Int. Cl.[3] ..... H01H 33/18

[52] U.S. Cl. ..... 200/147 R

[58] Field of Search ..... 200/147 R, 147 A

[56] References Cited

U.S. PATENT DOCUMENTS

| | | | |
|---|---|---|---|
| 2,147,430 | 2/1939 | Ellis et al. | 200/147 R |
| 2,337,949 | 12/1943 | Walle | 200/147 A |
| 3,155,801 | 11/1964 | Pokorny | 200/147 R |
| 3,178,545 | 4/1965 | Bogert et al. | 200/147 R |

FOREIGN PATENT DOCUMENTS

| | | | |
|---|---|---|---|
| 1417232 | 10/1965 | France | 200/147 R |
| 548810 | 10/1942 | United Kingdom | 200/147 A |

*Primary Examiner*—Robert S. Macon

*Attorney, Agent, or Firm*—William A. Drucker

[57] ABSTRACT

In a blowing chamber for the arcs appearing between the contacts of an electrical circuit breaking apparatus, e.g. a current limiting apparatus, a blowing loop is constituted by a conductor passing firstly parallel to a movable contact, then externally along a deflector, and finally opposite a massive part of split fins.

7 Claims, 9 Drawing Figures

Fig. 3
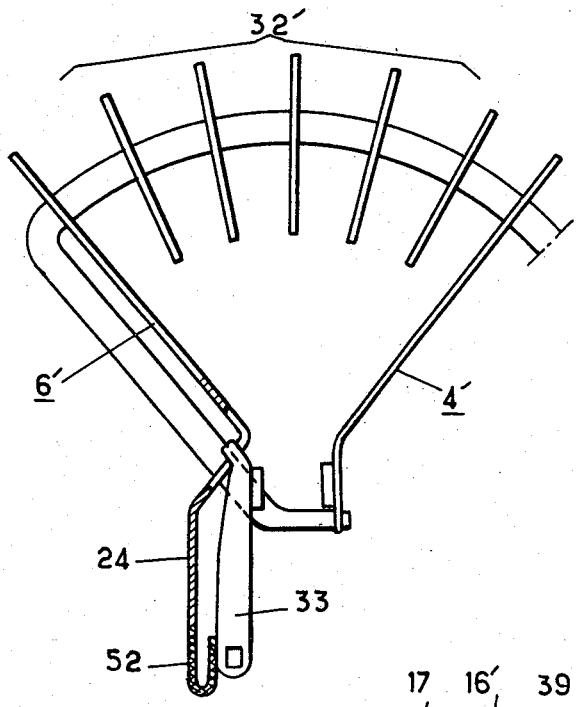
Fig. 5
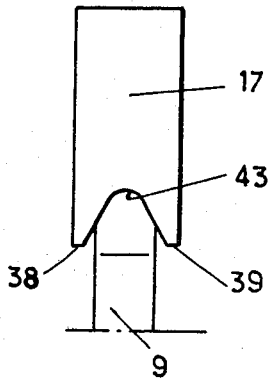
Fig. 4
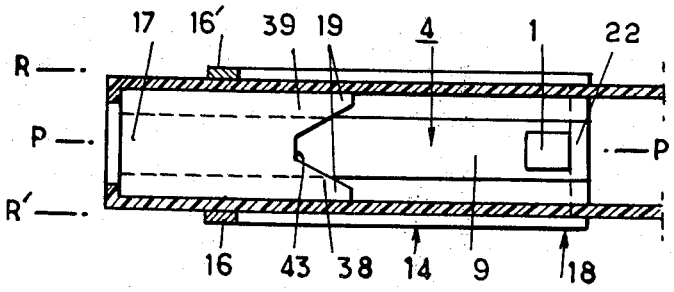
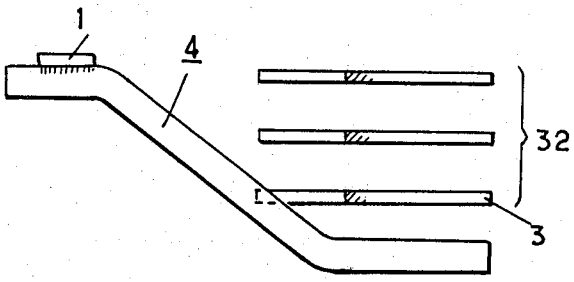
Fig. 7
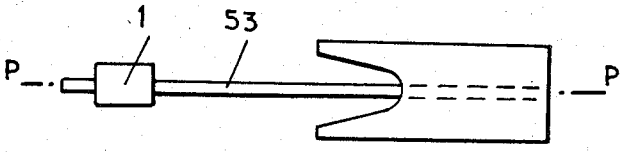
Fig. 6

ARC BLOWING CHAMBER

This is a continuation of Ser. No. 27,587 filed Apr. 6, 1979, now abandoned.

BACKGROUND OF THE INVENTION

The invention relates to a blowing chamber for electrical current-limiting contact breaking apparatus of the kind in which a fixed contact is coupled to a first deflector extending up to a first extremity of a series of arc splitting fins, whilst a contact, movable in a breaking zone, is in its open position in the vicinity of a second deflector extending up to a second extremity of the said series of fins, and wherein the fins, each having a massive part and a forked part directed towards the breaking zone, are placed in planes perpendicular to the plane of movement of the movable contact, whilst respective portions of the first and second deflectors comprises between the said series and the said zone, converge towards this latter and make a predetermined angle with the direction of movement of the movable contact, a magnetic arc blowing device being provided to assist its displacement towards the fins. Such a chamber is known for example from the U.S. Pat. No. 3,178,545, wherein the blowing device is not defined in a precise manner.

In a blowing chamber such as is described in that patent, the displacements of the arc bases are not sufficiently rapid for the intensity of the current to be limited at the moment of breaking, when this latter has been caused by an excessive value of the current.

OBJECT OF THE INVENTION

The invention proposes to apply, to this known device, an effective blowing means, and to shape the deflectors in such a manner as to avoid the stopping or the slowing of movement of the base of the arcs.

SUMMARY OF THE INVENTION

According to the invention this result is achieved in that the device comprises at least one blowing loop which is placed externally of the chamber in a plane parallel to the said plane of movement and which comprises a first portion coupled to the fixed contact and passing externally of the said breaking zone at a side opposite to the fins, a second portion passing parallel to the second deflector and at the exterior of the path followed by the arc base thereon, and a third portion passing opposite to the massive part of the fins.

THE PRIOR ART

There is known from U.S. Pat. No. 2,147,430 a breaking chamber in which a blowing loop coupled to the fixed contact passes in a lateral plane placed externally to the chamber and parallel to the plane of movement of the movable contact. In this known apparatus, wherein the deflectors do not converge towards the breaking zone and wherein the dimensions of the loop are only slightly greater than those of the said zone, the rapidity of movement of the arc does not permit the obtaining of breaking times which are low enough to limit large currents.

BRIEF DESCRIPTION OF THE DRAWINGS

FIG. 3 illustrates, seen in section, a simple contact breaking apparatus wherein the fins are not parallel;

FIG. 4 shows a side view of the chamber according to FIG. 1, deprived of the second deflector and of the movable contact;

FIG. 5 shows the shape of a fin adjacent to the deflectors;

FIGS. 6 and 7 illustrate a particular form of deflector, and

DESCRIPTION OF THE PREFERRED EMBODIMENT

Figure 1:
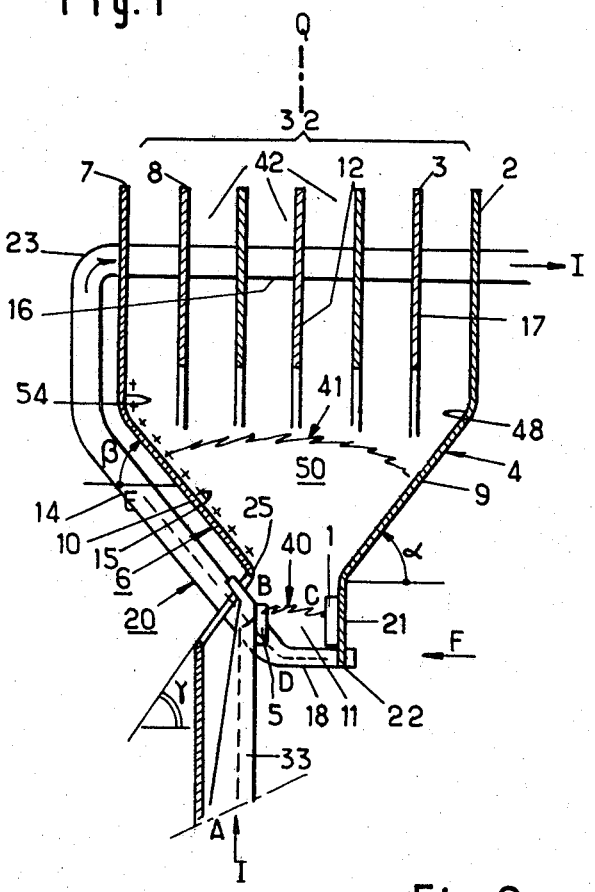
FIG. 1 shows a view in section of an arc chamber, taken through the plane of movement of the movable contact.

A contact breaking chamber 50 conforming to the invention comprises (see FIG. 1) a fixed contact 1 and a movable contact 5 secured on a conductive contact carrier 33 which moves in the plane of the figure; these contacts define a breaking zone 11 comprises between the fixed contact and the movable contact in the position shown which corresponds to the position of opening. The fixed contact 1 is disposed at one extremity of a first arc deflector 4 which is extended first of all by an inclined portion 9 making an angle $\alpha$ with the direction F of the movable contact, and then by a portion 2 extending to the vicinity of a first extremity 3 of a series of arc-splitting fins 32. A second arc deflector 6 comprises an extremity 25 placed in the vicinity of the movable contact 5 in its open position and is extended firstly by an inclined portion 10 making an angle $\beta$ with the direction F, and then by a portion 7 extending to the vicinity of a second extremity 8 of the said series of fins. The portions 9 and 10 converge substantially towards the breaking zone 11.

Each fin of the series 32 comprises a massive part 17 and a forked part 19 which is directed towards the breaking zone, see likewise FIG. 4. In the manner of construction shown in FIG. 1, the fins are parallel to each other and perpendicular to F, whilst the plane Q of the fin 12 placed substantially in the centre of the series 32 passes through the breaking zone.

Figure 8:
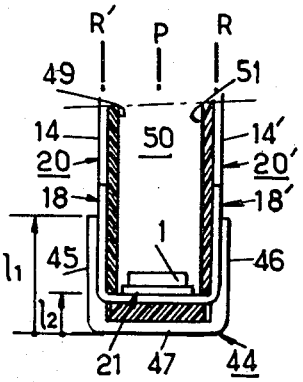
FIGS. 8 and 9 show a magnetic element associated with the breaking zone.

The magnetic blowing device is constituted by at least one conductor 20 passing externally about the breaking chamber 50, for example at the exterior of the parallel insulating cheeks 49, 51 and in a respective lateral plane R or R′ substantially parallel to the plane P in which the movable contact 5 moves, see in particular FIG. 4 and FIG. 8. This conductor is coupled to one extremity 22 of a region 21 of the first deflector 4 carrying the fixed contact 1; this extremity 22 will be formed by an extension of the region 21 and will advantageously be placed beyond this latter in a direction opposite to the fins, for the reasons explained below.

In a first portion 18 following on to its part coupled to the extremity 22, the conductor 20 passes round in such a manner as to pass at the exterior of the breaking zone, in order to form a loop of current with the arc path A B C D E; then follows a path 14 disposed externally of the path 15 which is followed by the base of the arc on the inclined portion 10 of the second deflector and finally describes a bend 23 which causes its portion 16 to pass opposite to the massive part 17 of the fins.

The importance of these various features is the result obtained by the reciprocal action of the current of the arc and the current circulating in the conductor of the loop.

In the breaking zone 11 where the arc 40 appears, see FIG. 1, it will be seen that the field created by the small loop comprised between 18, 22, 21, 40 and 5 is going to cause a displacement of the arc towards the fins by reason of the existence of the loop of current A, B, C, D, E. As soon as the arc 41 obtained by magnetic blowing of the preceding one causes the passage of the base of the arc over the portion 10 of the second deflector, this base will be subjected to an electro-dynamic force tending to cause in an effective manner its displacement towards the top of FIG. 1 if the path 15 which it follows along the deflector is placed at the interior of the loop traversed by a current passing through 14, 18, 22, 21, 9, 41, 15 and 25, in order to close itself again through the conductive parts 52,64 coupled either to the movable contact carrier 33 in the case of a simple contact breaker, or to a second deflector in the case of a double breaker, through the element 24, see FIG. 2.

When the arc base concerned moves along the second deflector, the other arc base moves along the first deflector, until the moment when the arc is split up on the forked part 19 of the fins 32. If the portion 16 was placed opposite to the forked part, the arc would have a tendency to stabilise itself parallel to said portion and its entry to the interior of the fins as well as its cooling would be considerably diminished. By reason of the position adopted by the portion 16 of the conductor 20 which is situated opposite to the massive part, the arc tends to extend itself up to the spaces 42 separating the massive part of the fins, in such a manner that its splitting up and its cooling are better assured.

Figure 2:
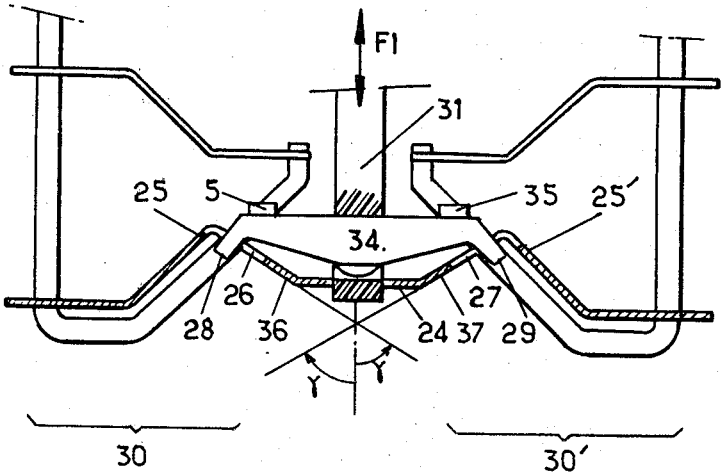
FIG. 2 shows, seen in section, a contact breaking apparatus utilising a contact bridge with double contact breaking and two arc chambers.

In the manner of construction of the invention applied to a double-breaker apparatus and shown in FIG. 2, the elements of FIG. 1, having the same function, have the same references. Two chambers 30, 30', identical to those which have just been described, are each associated with one of two movable contacts 5, 35, carried by a contact bridge 34 which can move along $F_1$ at the same time as the insulating contact carrier 31 with which it is associated. Two arcing horns 28, 29, adjacent to the contacts 5, 35 are disposed on the extremities of the bridge in order to ensure a better transfer of the base of the arc towards the extremity 25 of the second deflector 6.

As the extremity 25 of the second deflector of the chamber 30 must be electrically connected to the analogous extremity 25' of the second deflector 6' of the chamber 30', the cross member 24 which couples these two extremities has been provided with two openings 26, 27, which permit the two horns to enter.

The cross member 24, the central portion of which runs parallel to the contact bridge and below it, is coupled to the extremities 25, 25', by two inclined regions 36, 37, in which are disposed the openings mentioned above.

These inclined regions make, with respect to the direction F or $F_1$ an angle $\gamma$ which will be in the neighbourhood of 90°, in order that the currents flowing in the regions 36,37 at each side of the openings do not create a parasitic magnetic field the orientation of which would cause restraint of the arc base at the moment of its departure along the second deflector, or even a certain pausing of this arc base on the extremity 25.

The features which have just been described can likewise be applied to the simple breaker chamber which is described either in FIG. 1 or in FIG. 3, and in this case the region 24 would be electrically connected to the contact carrier 33 movable in translation or in rotation, for example by a conductive braid 52.

FIG. 3 shows a blowing chamber for a simple breaker apparatus, in which the features described below have been applied to a series of fins 32' disposed radially with respect to the breaking zone; in this case, the first and second deflectors 4', 6' do not have end portions comparable to the extremities 2, 7 described in FIG. 1.

When it is desired to increase the voltage of the arc by multiple splitting thereof, it is necessary to increase the number of fins. The fins such as 3 and 8 disposed at the extremities of the series of fins 32 could in this case have arms 38, 39 of their fork 19 at such a distance from the portions 9 and 10 of the two deflectors, that the arc would not be able to enter as far as the base 43 of the said forks (see FIGS. 1 and 4).

In order to avoid the inconvenience in question, at least the arms 38, 39 of the fins 2 and 8 are curtailed in order to remain at a sufficient distance from the deflectors, as can be seen in FIG. 5.

In the same region there will also advantageously be provided arcuate connecting portions 48, 54 between the respective straight portions 2 and 9, and 7 and 10, of the deflectors, this connection being placed substantially in extension of the bases 43 of the forks 19.

In a manner of construction permitting, on the one hand, the use of fins having extremities identical to the others, and on the other hand the acceleration of the arc base, at least one of the deflectors 4 (for example the first) will be formed by a flat conductor 53 cut out of a sheet of metal of small thickness and the plane of which would be placed in the plane P, see FIG. 6.

Figure 9:
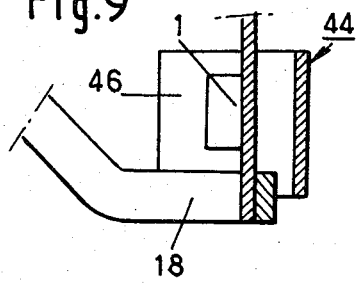

Finally, there can advantageously be associated with the breaking zone 11 a magnetic element in the form of a "U" 44 (see FIGS. 8 and 9), the arms 46 and 45 of which, of greater or lesser length $l_1$, $l_2$, are placed substantially in the planes R and R' defined above, and of which the base 47 connecting the two arms is placed outside the said zone, for example at the opposite side to the fixed contact.

We claim:

1. An electric circuit breaker comprising:

a fixed contact;

a conductive contact carrier and a movable contact secured to said contact carrier, said contact carrier being movable along a predetermined direction contained in a predetermined plane, from a first position wherein the movable contact engages the fixed contact, to a second position wherein the movable contact is separated from the fixed contact;

a breaking zone defined between the fixed contact and the second position of the movable contact;

a plurality of arc plates arranged at right angles to the said plane and substantially directed towards the breaking zone, the said plurality comprising first and second outer arc plates and a plurality of inner arc plates located between the first and second outer arc plates, each of said outer and inner arc plates having a non forked part and a forked part which is nearest the breaking zone;

a first elongated arc deflector having a first portion facing the first outer arc plate a second portion to which the said fixed contact is secured and an intermediate portion connecting the first and second portions;

a second elongated arc deflector a first portion having an inner surface which faces the second outer arc plate, said first portion further having an outer surface a second portion located in the vicinity of the second position of the movable contact and electrically connected to the said contact carrier and an intermediate portion connecting the said first and second portions of the second deflector, the said intermediate region of the second deflector having an inner surface portion opposite to the intermediate region of the first deflector and an outer surface, at least the intermediate regions of the said first and second deflectors both converging towards the breaking zone and respectively making first and second angles with respect to the said predetermined direction;

a blowout loop which has at least one conductor part located in at least one further plane which is parallel to the said predetermined plane, and located externally of the arc plates, said conductor part having a second portion connected at the extremity of the second portion of the first deflector and being parallel to the breaking zone, a first portion, which is located in the vicinity of the said non forked parts of the arc plates, and an intermediate portion connecting the said first and second portions, said intermediate portion being parallel to the intermediate and first portions of the second deflector and located opposite to the outer surfaces of the said intermediate and first portions of the second deflector.

2. An electric circuit breaker as claimed in claim 1, wherein the said second deflector has a first extension which is connected to the second portion of the said second deflector and a second extension parallel to the said contact carrier, said electric circuit breaker further comprising a conductor having a first end connected to the said contact carrier and a second end, the said second extension being connected to the first extension and to the second end of the said conductor and the first extension making, with the second portion of the second deflector, an angle higher than 90°.

3. An electric circuit double-breaker comprising:

first and second separated fixed contacts;

a conductive contact carrier having first and second opposite ends;

first and second movable contacts respectively secured to the contact carrier at the first and second ends thereof, said contact carrier being movable along a predetermined direction contained in a predetermined plane, from a first position wherein the respective movable contacts engage the respective fixed contacts, to a second position wherein the movable contacts are separated from the fixed contact and first and second blowing means each including: a breaking zone located between the respective fixed contact and the second position of the respective movable contact;

a plurality of arc plates arranged at right angles to the said predetermined plane and substantially directed towards the breaking zone, the said plurality including first and second outer arc plates and a plurality of inner arc plates located between the first and second outer arc plates, each of the said outer and inner arc plates having a non forked part and a forked part which is nearest the breaking zone;

a first elongated arc deflector having a first portion facing the first outer arc plate, a second portion to which the respective fixed contact is secured and an intermediate portion connecting the first and second portions;

a second elongated arc deflector comprising a first portion having an inner surface which faces the second outer arc plate, said first portion further having an outer surfaces a second portion located in the vicinity of the second position of the respective movable contact and an intermediate portion connecting the said first and second portions of the second deflector, the said intermediate of the first and second deflectors having an inner surface portion opposite to the intermediate portion of the first deflector and an outer surface, the second portion of the second deflector of the first and second blowout means each having an extension, at least the intermediate portions of the first and second deflectors both converging towards the breaking zone and respectively making first and second angles with respect to the said predetermined direction; and a blowout loop which has at least one conductor part located in at least one further plane which is parallel to the said predetermined plane, and located externally of the arc plates, said conductor part having a second portion connected at the extremity of the second portion of the first deflector and being parallel to the breaking zone, a first portion, which is located in the vicinity of the said non forked parts of the arc plates, and an intermediate portion connecting the said first and second portions, said intermediate portion being parallel to intermediate and first portions of the second deflector and located opposite to the outer surfaces of the said intermediate and first portions of the second deflector;

and a cross member electrically connecting together the said extensions of the second deflectors of the first and second blowout means.

4. An electric circuit breaker as claimed in claims 1, 2, or 3, wherein the forked parts of each of the said arc plates have a base portion, the first portions of the first and second deflectors, and the said outer and inner arc plates are parallel, the first portion and the intermediate portion of the first and second deflectors are coupled together through first and second respective arcuate portions and the said first and second arcuate portions and the said base portion of the fork parts are substantially aligned together.

5. An electric circuit breaker as claimed in claim 1, 2 or 3, wherein the first portion and the intermediate portion of the first and second deflectors and the outer and inner arc plates are radially directed towards the breaking zone.

6. An electric circuit breaker as claimed in claims 1, 2, or 3, wherein the forked part of each of the said arc plates has a base portion, the first and intermediate portions of the first and second deflectors are coupled together through first and second respective arcuate portions and the said base portions of the arc plates are substantially aligned with the said arcuate portions.

7. An electric circuit breaker as claimed in claims 2 or 3, wherein the said contact carrier has an arcing horn at one end thereof located in the vicinity of the movable contact; the said first extension makes a predetermined angle with the first portion of the second deflector and has an opening which is arranged in such a manner that the said arcing horn penetrates into the said opening when the said contact carrier is in the second position.

* * * * *